US005621955A

United States Patent [19]

Schmid et al.

[11] Patent Number: 5,621,955

[45] Date of Patent: Apr. 22, 1997

[54] CLAMP MADE OF PLASTIC FOR CLAMPING SHEET-LIKE OBJECTS

[76] Inventors: Dieter Schmid, Radaustrasse 23a, D-86199 Augsburg; Oliver Schmid, Grundweg 2, D-86356 Neusäss, both of Germany

[21] Appl. No.: 446,680

[22] PCT Filed: Jul. 16, 1993

[86] PCT No.: PCT/EP93/01867

§ 371 Date: Aug. 4, 1995

§ 102(e) Date: Aug. 4, 1995

[87] PCT Pub. No.: WO94/13494

PCT Pub. Date: Jun. 23, 1994

[30] Foreign Application Priority Data

Dec. 11, 1992 [DE] Germany ..... 92 16 896.5

[51] Int. Cl.[6] ..... A44B 21/00; A47G 25/48

[52] U.S. Cl. ..... 24/511; 223/91

[58] Field of Search ..... 24/500–502, 510, 24/511, 508, 498, 499, 67.3, 67.5, 67.7, 362, 545, 562, DIG. 8; 223/91, 96

[56] References Cited

U.S. PATENT DOCUMENTS

| | | | |
|---|---|---|---|
| 1,891,494 | 12/1932 | Baltzley | 24/501 |
| 2,879,568 | 3/1959 | Killen | 24/67.5 |
| 3,096,551 | 7/1963 | Shoberg | D32/61 X |
| 3,756,550 | 9/1973 | Kollitz | 24/511 X |
| 4,010,879 | 3/1977 | George et al. | 223/96 |
| 4,394,791 | 7/1983 | Groth | 24/511 X |
| 4,395,799 | 8/1983 | Batts | 223/96 X |
| 4,660,750 | 4/1987 | Blanchard | 223/91 |
| 4,685,996 | 8/1987 | Warmath | 223/96 |
| 4,718,581 | 1/1988 | Chiaramonte | 223/96 |
| 4,984,721 | 1/1991 | Eiley et al. | 223/91 X |
| 5,075,935 | 12/1991 | Abdi | 24/511 |
| 5,082,153 | 1/1992 | Duester et al. | 233/91 X |
| 5,318,292 | 6/1994 | De Marco | 24/511 X |
| 5,361,948 | 11/1994 | Batts | 223/91 X |
| 5,402,558 | 4/1995 | Santapa | 24/501 X |
| 5,457,858 | 10/1995 | Lin | 24/511 |

FOREIGN PATENT DOCUMENTS

| | | |
|---|---|---|
| 377467 | 6/1923 | Germany . |
| 7406519 | 8/1974 | Germany . |
| 3623766C1 | 6/1987 | Germany . |
| 8912654 U | 2/1990 | Germany . |
| 267326 | 3/1927 | United Kingdom . |

*Primary Examiner*—Peter M. Cuomo
*Assistant Examiner*—Robert J. Sandy
*Attorney, Agent, or Firm*—McGlew & Tuttle

[57] ABSTRACT

A clamp made of plastic for clamping sheet-like objects. To easily clamp objects manually over the longest possible clamping line with the strongest possible clamping force, the present invention provides two mounting sites for two clamping levers. The mounting sites are parallel to the clamping line, are located at spaced locations from one another, and are connected to one another in an articulated manner. A U-shaped spring includes legs which are spring-tensioned against the clamping jaws of the clamping levers.

5 Claims, 1 Drawing Sheet

CLAMP MADE OF PLASTIC FOR CLAMPING SHEET-LIKE OBJECTS

FIELD OF THE INVENTION

The present invention pertains to a clamp made of plastic for clamping sheet-like objects, in which the clamping jaws of two clamping levers connected to one another in an articulated manner are tensioned against each other by means of spring force along a clamping line.

BACKGROUND OF THE INVENTION

In a prior-art clothespin, the two clamping levers are traversed by the cylindrical coil of a torsion spring and thus they are rotatably guided. The two spring ends extend with bent webs to the outer surface of the clamping jaws. Such a system is unsuitable for use when objects are to be clamped along a longer clamping line, as in the case of, e.g., the closing of open bags, containers and the like.

Clamps corresponding to German Utility Model DE-GM 89 12 654 are more suitable for the latter purpose, because they have clamping levers with elongated clamping jaws. These clamping levers are tensioned against each other by a leaf spring made in one piece with them, which entails the problem of generating a sufficiently strong clamping force.

Finally, it has been known from DE-A 36 23 766 that clamping levers consisting of plastic can be connected to the front-side ends of a clamp, which has the shape of a U and consists of spring steel. Even though a strong clamping force can be generated with such a clamp, the clamping line is relatively short. If one wished to increase the length of the clamping line of this prior-art clamp, which would automatically have to be accompanied by an increase in the length of the clamp, the resistance of the spring for spreading apart the clamp manually would be too high.

A clamp made of sheet metal parts, which is able to clamp and hold sheet-like objects as a consequence of an elongated clamping line, has been known from GB-A-26 73 26. The clamp has two clamping jaws, which are mounted on each other and have arched projections for surrounding a pivot pin located between them in the area of two support points located at spaced locations from one another. A hollow cylindrical, longitudinally slotted metal spring surrounds the individual support point and holds the clamping jaws together in a non-positive manner. In addition, a handle, formed by a bent wire, is hung on each clamping jaw under spring tension.

The prior-art clamp requires a considerable amount of tools and assembly due to its consisting of many parts, and it is susceptible to rusting.

DE-U-74 06 519 discloses a clothespin made of plastic, which has a relatively short, arched clamping surface on each clamping jaw, which forms one physical unit with the clamping lever associated with it. The clamping jaws are in contact with one another in the resting position, and they are secured against lateral displacement by a pin, which engages a recess. A U-shaped plastic clamp surrounds undercut projections of both clamping jaws, which have lateral recesses for inserting the plastic clamps.

This document fails to offer any suggestion on how sheet-like objects can be held along a long clamping line with the necessary clamping force.

SUMMARY AND OBJECTS OF THE INVENTION

The basic task of the present invention is therefore to develop a clamp for sheet like objects with the longest possible clamping line, which can easily be operated manually, which generates a sufficiently strong tensioning force to securely close, e.g., even opened bag-type packages, and has a very simple design.

Based on the shape of the clamp according to DE-GM 89 12 654, the task according to the present invention is accomplished by the clamp having two mounting sites for the clamping levers, which are parallel to the clamping line, are located at spaced locations from one another, and each of which is encompassed by a U-shaped spring, whose legs are spring-tensioned against the clamping jaws. As a consequence of this arrangement of relatively short, U-shaped springs, it is possible to form clamps of a desired clamping line length, with which a sufficient tensioning force is generated and yet a relatively easy operation with manual force is made possible.

Even though it has been known from DE-PS 377 467 that two metallic clamping jaws can be guided on two balls located at spaced locations from one another and that they can be tensioned with a long spring sleeve against the balls, this does not accomplish the task of the present invention, because the long spring sleeve requires a disproportionately strong spreading force if a sufficient clamping force is to be generated along the clamping line.

The clamp according to the present invention may be used for a great variety of purposes, e.g., for clamping a plurality of sheets, for clamping heavy objects, or for closing opened packages, bags, etc. The present invention is not limited to these application examples.

It is advantageous, e.g., to form the individual mounting site from a cup-shaped groove on one clamping lever and from a bead fittingly engaging the groove on the other clamping lever, which are held in their engaged position by the spring legs encompassing them. It is advantageous for the individual spring with its legs to be fixed on the clamping jaws of the clamp in the manner of a snap closure.

In an advantageous exemplary embodiment of the present invention, the individual clamping jaw has, in the area of each mounting site, a recess, which corresponds to the length of the clamp, is open opposite the clamping line, and is engaged by the legs of the spring. The spring can therefore be pressed into the recess from the top and a nonpositive connection of the clamping levers in their mounting sites can be brought about.

The wall limiting the recess on the inside under the mounting axis advantageously has a strip-shaped projection, behind which extends a bead-like thickening of the leg edge of the spring. The snap closure-like connection of the clamping levers is facilitated and their detachment is made possible by this arrangement.

The grip part, which is present on each clamping lever, is preferably arranged between the mounting sites, and the grip part has, of course, a shape extending away from the clamping line.

However, the present invention is not limited to having to manufacture two clamping levers separately and to connect them to one another. It is also possible to connect the clamping levers in the area of the mounting sites by a thin, arched wall section to form a one-part clamp according to the injection molding technology, in which case it is only recommended to provide for suitable centering measures between the two legs of the one-part clamping lever in order to reach a definite clamping position when the springs are pushed on.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
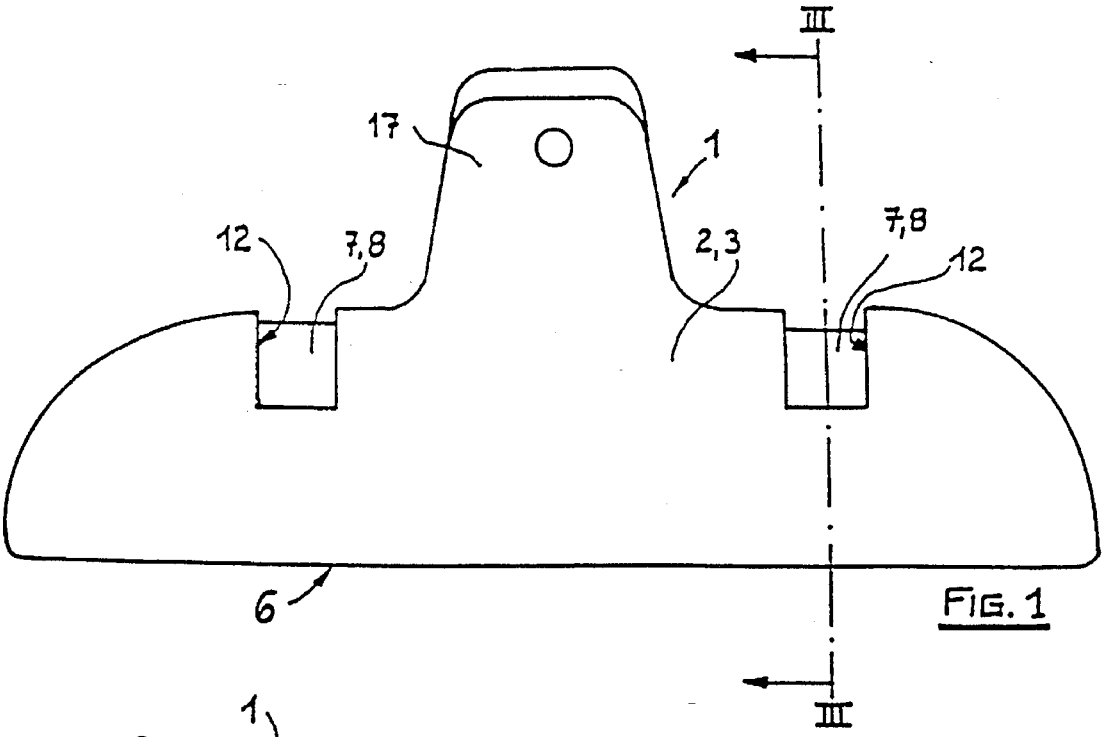
FIG. 1 shows a side view of a clamp.
Figure 2:
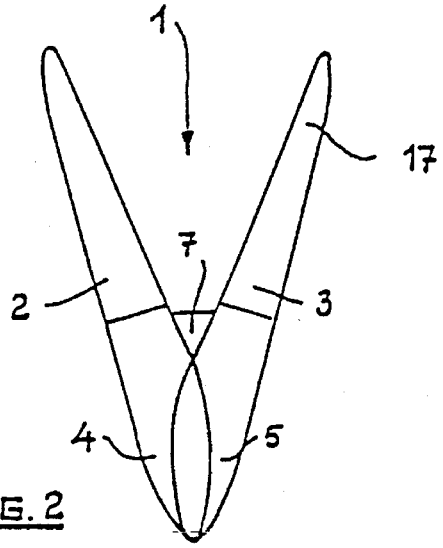
FIG. 2 shows a front view of the clamp according to FIG. 1.

Referring to the drawings, the side view according to FIG. 1 shows a clamp of, e.g., natural size, as it can be used especially to dose opened bags or the like. However, the present invention is not limited to the size of the clamp shown.

A clamping line, whose length reflects the clamping length of the clamp 1, is designated by 6. The clamp 1 itself consists of two clamping levers (or left half body and right half body) 2, 3 made of plastic, which are connected to one another in an articulated manner in the area of two support sites or mounting means 8, as is apparent from, e.g., FIGS. 3 and 4. However, this connection of the clamping levers 2, 3 should be understood to be only a rotation centering. The clamp 1 requires the additional arrangement of U-springs 7 to connect the clamping levers 2, 3 to one another in a nonpositive or non-interlocking manner. The clamping levers having handles (or projection heads) 17 positioned substantially at the middle of the clamping line 6.

Figure 3:
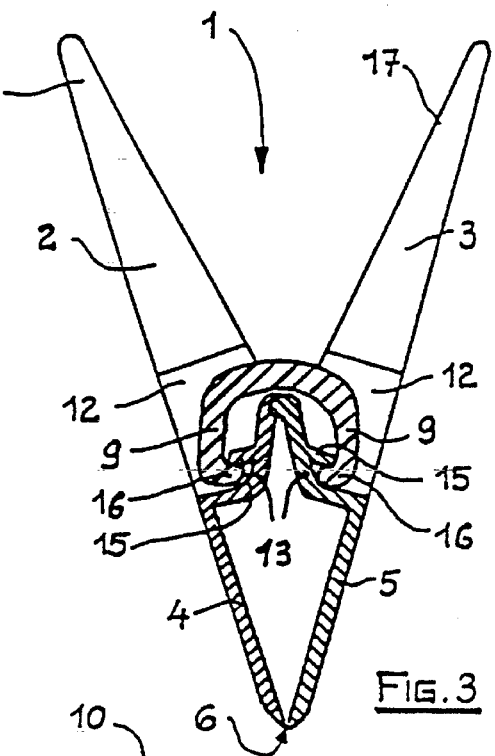
FIG. 3 shows a cross section through the clamp along line III—III according to FIG. 1 (on a larger scale)
Figure 4:
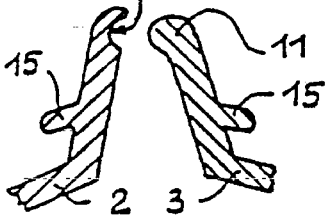
FIG. 4 shows a partial cross section through the clamping levers of the clamp in the area of their mounting site in the opened position.

As is apparent, especially from the cross section according to FIG. 3, the clamping jaw 4 of the clamping lever 2 has, in the area of the mounting means or support site 8, a cup-shaped groove (or lengthwise groove) 10, which is engaged by a bead (or lengthwise round ridge) 11 of the clamping jaw 5 of the other clamping lever 3. When a U-shaped spring (or U-shaped clasp) 7, which may consist of an elastic plastic, is pushed from the top with its legs 9 over the mounting site 8, i.e., over the groove 10 and the bead 11, the tensioning or clamping force of the legs 9 acts against the walls 13 of the clamping jaws 4, 5, and the clamping jaws are firmly tensioned against each other in the area of the clamping line 6.

To push the U-spring 7 from the top into the mounting sites 8, recesses (or clasp openings) 12, which are open in the upward direction and are limited on the inside by the walls 13, are provided on the clamping jaws 4, 5. As is apparent especially from FIG. 1, the U-springs 7 can be easily inserted into the recesses 12 from the top.

The outsides of the walls 13 have strip-shaped projections 15, behind which extend bead-like thickenings or lips 16 of the legs 9 of the U-spring 7. Consequently, the shape of the U-spring 7 should be selected to be such that the bead-like thickenings 16 are still able to pass over the strip-shaped projections 15 (which form a lengthwise round ridge or rounded portion) when the spring 7 is pushed into the recess 12 (which is a lengthwise groove under the rounded portion of projections 15). In the snapclosure position according to FIG. 3, the legs 9 of the spring 7 must then be pretensioned to the extent that they exert a sufficient closing pressure on the clamping jaws 4, 5.

It is now possible to exert the actually desired closing pressure of the clamp 1 by correspondingly dimensioning the springs 7. It is essential that the mounting axis of the individual mounting site 8 is encompassed by the web of the spring 7 from the top.

It is easy to understand that the spring 7 can easily be released from its tensioning or clamp position by means of suitable tools, which grip under the spring legs 9.

Figure 5:
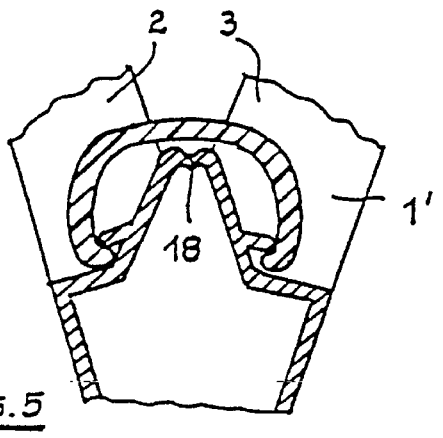
FIG. 5 shows a cross section through an alternative one-part clamp.

The example in FIG. 5 shows an alternative of the present invention, which is based on a one-part clamp 1'. Instead of the groove 10 and bead 11, shown in FIG. 3, the two clamping levers 2, 3 are connected to one another by an arched or tapered wall section 18 of reduced thickness, which acts like a hinge. Only the U-shaped spring 7 needs to be clipped on from the top to form an effective clamp in this case as well.

While specific embodiments of the invention have been shown and described in detail to illustrate the application of the principles of the invention, it will be understood that the invention may be embodied otherwise without departing from such principles.

LIST OF REFERENCE NUMBERS

1 Clamp (multipart)
1' Clamp (one-part)
2 Clamping lever
3 Clamping lever
4 Clamping lever
5 Clamping jaw
6 Clamping line
7 U-spring
8 Mounting site
9 Leg
10 Groove
11 Bead
12 Recess
13 Wall
14 Mounting axis
15 Strip-shaped projection
16 Bead-like thickening
17 Grip part
18 Arched wall section

We claim:

1. A sheet clamp comprising:

a first clamping lever including a clamping jaw, said clamping jaw extending along a clamping line, said first clamping lever also including a handle positioned substantially at a middle of said clamping line, said first clamping lever with said handle and said clamping jaw being formed as a single piece of plastic, said first clamping lever defining a first lever first recess and a first lever second recess, said first lever first recess and said first lever second recess being positioned substantially symmetrically about said handle in a direction of said clamping line, said first lever first recess and said first lever second recess each being open in a direction away from said clamping line;

a second clamping lever having a clamping jaw, said clamping jaw extending along said clamping line, said second clamping lever also including a handle positioned substantially at a middle of said clamping line, said second clamping lever with said handle and said clamping jaw being formed as a single piece of plastic, said second clamping lever defining a second lever first recess and a second lever second recess, said second lever first recess and said second lever second recess being positioned substantially symmetrically about said handle in said direction of said clamping line, said second lever first recess and said second lever second recess being open in said direction away from said clamping line;

mounting means positioned adjacent to said first lever first recess, said first lever second recess, said second lever first recess and said second lever second recess; said mounting means for pivotably connecting said first and second clamping levers, said mounting means including a bead integrally formed with said first clamping lever and including a groove defined by said second clamping lever;

a first lever first recess shaped projection providing a projection surface positioned in said first lever first recess;

a first lever second recess shaped projection providing a projection surface positioned in said first lever second recess;

a second lever first recess shaped projection providing a projection surface positioned in said second lever first recess; a second lever second recess shaped projection providing a projection surface positioned in said second lever second recess;

and spring means for biasing said bead and said groove together and for biasing said clamping jaws of said first and second clamping levers together, said spring means including a first u-shaped spring with legs including lips which are slidable over said first lever first recess shaped projection and said second lever first recess shaped projection and for forming a snap like closure with said first lever first recess shaped projection and said second lever first recess shared projection and a second u-shaped spring with legs, said legs including lips which are slidable over said first lever second recess shaped projection and said second lever second recess shaped projection and for forming a snap like closure with said second lever first recess shaped projection and said second lever second recess shaped projection.

2. A clamp in accordance with claim 1, wherein:

said spring of said spring means consists of elastic plastic.

3. A clamp in accordance with claim 1, wherein:

said bead and groove engage to form a non-interlocking connection.

4. A sheet clamp comprising:

a first clamping lever including a clamping jaw, said clamping jaw extending along a clamping line, said first clamping lever also including a handle positioned substantially at a middle of said clamping line, said first clamping lever with said handle and said clamping jaw being formed as a single piece of plastic, said first clamping lever defining first and second recesses positioned substantially symmetrically about said handle in a direction of said clamping line, said first and second recesses being open in a direction away from said clamping line;

a second clamping lever having a clamping jaw, said clamping jaw extending along said clamping line, said second clamping lever also including a handle positioned substantially at a middle of said clamping line, said second clamping lever with said handle and said clamping jaw being formed as a single piece of plastic, said second clamping lever defining first and second recesses positioned substantially symmetrically about said handle in said direction of said clamping line, said first and second recesses being open in said direction away from said clamping line;

mounting means positioned in said first and second recesses of both first and second clamping levers and for pivotably connecting said first and second clamping levers, said mounting means including a flexible arched wall section integrally connected to said first and second clamping lever in one of said first and second recesses;

strip shaped projections integrally formed with said first and second clamping levers and positioned in said first and second recesses of both said first and second clamping levers;

spring means positionable in said first and second recesses and for biasing said clamping jaws of said first and second clamping levers together, said spring means including a U-shaped spring with legs, said legs including lips which are slidable over said strip shaped projections and form a snap like closure with said strip shaped projections.

5. A clamp in accordance with claim 4, wherein:

said first and second clamp levers and said mounting means are formed together as a single integral unit;

said arched wall section has a thickness to cause the pivotable connection between said first and second clamp levers.

* * * * *